US007946902B2

(12) United States Patent
Willett et al.

(10) Patent No.: US 7,946,902 B2
(45) Date of Patent: May 24, 2011

(54) ARTICULATED WALKING TOY

(75) Inventors: William Willett, Irvine, CA (US); Chung Ming (Bryan) Cheng, Kowloon (CN); Chun Wing (Edward) Wong, Kowloon (CN)

(73) Assignee: Mattel, Inc., El Segundo, CA (US)

( * ) Notice: Subject to any disclaimer, the term of this patent is extended or adjusted under 35 U.S.C. 154(b) by 100 days.

(21) Appl. No.: 12/263,917

(22) Filed: Nov. 3, 2008

(65) Prior Publication Data

US 2009/0117820 A1 May 7, 2009

Related U.S. Application Data

(63) Continuation of application No. PCT/US2007/010991, filed on May 4, 2007.

(60) Provisional application No. 60/797,781, filed on May 4, 2006.

(51) Int. Cl.
*A63H 3/46* (2006.01)

(52) U.S. Cl. ..... 446/383; 446/353; 446/376; 446/377

(58) Field of Classification Search ..... 446/353, 446/355, 356, 376, 377, 381, 383
See application file for complete search history.

(56) References Cited

U.S. PATENT DOCUMENTS

| | | | |
|---|---|---|---|
| 188,841 | A | 3/1877 | Baxter, Jr. |
| 538,007 | A | 4/1895 | Adam |
| 1,196,548 | A | 8/1916 | Keffer |
| 1,511,928 | A | 10/1924 | Zboril |
| 1,576,956 | A | 3/1926 | Dunshee |
| 1,770,248 | A | 7/1930 | Van Vilet |
| 2,051,221 | A | 8/1936 | Nodding |
| 2,667,719 | A | 2/1954 | Edwardson |

(Continued)

FOREIGN PATENT DOCUMENTS

CN 2690007Y Y 4/2005

(Continued)

OTHER PUBLICATIONS

Small World Toys 1995 Catalog; received Feb. 1995; p. 36, Creepy Crawler Beetle.

(Continued)

*Primary Examiner* — Gene Kim
*Assistant Examiner* — Joseph B Baldori
(74) *Attorney, Agent, or Firm* — Panitch Schwarze Belisario & Nadel LLP

(57) ABSTRACT

An articulated walking device, configured for movement across a surface, includes a frame and a plurality of leg assemblies movably coupled with the frame so as to at least partially support the frame for movement across the surface. Each leg assembly includes a leg member configured to rotate with respect to the frame about a joint. The joint is formed by a pin passed through an at least generally hour glass shaped aperture to provide rotational movement of the leg member with respect to the frame about at least first and second axes of rotation intersecting in the joint. A drive mechanism is operatively engaged with the plurality of leg assemblies so as to actuate each of the leg members to rotate about the first and second axes in a like, predetermined, repeatable cycle of movement. At least some of the leg members are out of phase with other leg members to produce an anatomic-like gait of the toy device upon actuation of the drive mechanism.

25 Claims, 6 Drawing Sheets

U.S. PATENT DOCUMENTS 2,827,735 A 3/1958 Grimm, Jr.
2,918,738 A 12/1959 Barr
3,002,578 A 10/1961 Kraus
3,103,762 A * 9/1963 Glass et al. ..... 446/191
3,226,878 A 1/1966 Glass et al.
3,331,463 A 7/1967 Kramer
3,579,900 A 5/1971 Brown
3,603,029 A 9/1971 Nutting
3,678,617 A 7/1972 Nomura et al.
4,182,076 A 1/1980 Gay et al.
4,216,612 A 8/1980 Erickson et al.
4,224,759 A 9/1980 Saint-Pierre et al.
4,302,903 A 12/1981 Pun et al.
4,333,259 A 6/1982 Pin-Huang et al.
D266,777 S 11/1982 Lucas, Jr. et al.
4,365,437 A 12/1982 Jameson
4,527,650 A 7/1985 Bartholet
4,530,672 A 7/1985 Yoneda et al.
4,579,013 A 4/1986 van Essen et al.
4,614,504 A 9/1986 Yamasaki
4,629,440 A 12/1986 McKittrick, Jr. et al.
D289,070 S 3/1987 Forbes et al.
4,666,419 A 5/1987 Droller et al.
4,680,022 A 7/1987 Hoshino et al.
D291,711 S 9/1987 Dixon
4,708,685 A 11/1987 Udagawa
4,762,513 A 8/1988 Choy et al.
4,852,288 A 8/1989 Payne et al.
4,862,980 A 9/1989 Shkolnik
4,925,427 A 5/1990 Wu et al.
5,005,658 A 4/1991 Bares et al.
5,040,626 A 8/1991 Paynter
5,112,265 A 5/1992 Naum
5,125,668 A * 6/1992 Welte ..... 273/357
5,158,493 A 10/1992 Morgrey
5,219,410 A 6/1993 Garrec et al.
5,224,390 A 7/1993 Tysver
5,310,378 A 5/1994 Shannon
5,423,708 A 6/1995 Allen
D374,694 S 10/1996 Arai et al.
5,613,317 A 3/1997 Ninegar
5,685,383 A 11/1997 Ferrante
5,701,878 A 12/1997 Moore et al.
5,724,954 A 3/1998 Smith
5,762,153 A 6/1998 Zamagni et al.
5,842,533 A 12/1998 Takeuchi et al.
5,857,533 A 1/1999 Clewett et al.
D405,780 S 2/1999 Smith
D408,394 S 4/1999 Chin et al.
5,941,755 A 8/1999 Danielian
5,993,286 A 11/1999 Tacquard et al.
D418,551 S 1/2000 Kageyama et al.
6,012,962 A 1/2000 Arriola
6,036,572 A * 3/2000 Sze ..... 446/177
6,092,322 A 7/2000 Samaras
6,095,887 A 8/2000 Llorens et al.
6,109,378 A 8/2000 Paakkunainen et al.
6,123,600 A 9/2000 Yuen
6,165,043 A 12/2000 Terzian et al.
6,210,249 B1 4/2001 Stadlbauer et al.
6,238,264 B1 5/2001 Kazami et al.
6,273,782 B1 8/2001 Chan et al.
6,290,567 B1 9/2001 Chiu et al.
D461,855 S 8/2002 Ewert
D464,093 S 10/2002 Weiser et al.
6,478,314 B1 11/2002 Klann
6,481,512 B1 11/2002 Nagatsuka et al.
6,481,513 B2 11/2002 Buehler et al.
6,488,560 B2 12/2002 Nishikawa et al.
6,527,619 B1 * 3/2003 Agostini et al. ..... 446/435
6,588,701 B2 * 7/2003 Yavnai ..... 244/23 A
D478,589 S 8/2003 Hussaini et al.
D478,590 S 8/2003 Hussaini et al.
6,620,021 B2 9/2003 Liu et al.
6,652,352 B1 11/2003 MacArthur et al.
6,681,150 B1 * 1/2004 Haga et al. ..... 700/245
6,695,673 B1 2/2004 Stadbauer et al.
6,699,098 B1 3/2004 Kau
6,705,917 B2 3/2004 Filo
6,722,939 B2 4/2004 An et al.
6,736,694 B2 5/2004 Hornsby et al.
6,752,683 B1 6/2004 Godfrey
6,866,557 B2 3/2005 Randall
D517,131 S 3/2006 Carruth
7,115,014 B2 10/2006 McGrath et al.
D576,217 S 9/2008 Pasko
2001/0029147 A1 10/2001 Hornsby et al.
2001/0054518 A1 12/2001 Buehler et al.
2002/0025756 A1 2/2002 Nishikawa
2002/0111113 A1 8/2002 Filo
2002/0193045 A1 12/2002 Lee et al.
2003/0017779 A1 1/2003 Sakai
2003/0092353 A1 5/2003 Liu
2003/0232570 A1 12/2003 An
2004/0038619 A1 2/2004 Kau
2006/0014470 A1 1/2006 Takahashi et al.
2008/0108276 A1 5/2008 Willett et al.

FOREIGN PATENT DOCUMENTS

EP 389243 9/1990
EP 399720 11/1990
GB 2244935 12/1991
JP 59057074 4/1984
JP 61139567 6/1986
JP 2001071284 3/2001
JP 2001224866 8/2001
JP 2005193329 7/2005

OTHER PUBLICATIONS

Playthings® catalog, 2006. p. 32, Creepy Crawlers.
CN200780016217.X office action issued Mar. 19, 2010.
CN2006800410315 office action issued Jun. 19, 2009.

* cited by examiner

ARTICULATED WALKING TOY

CROSS-REFERENCE TO RELATED APPLICATIONS

This patent application claims priority to U.S. Provisional Patent Application No. 60/797,781, filed May 4, 2006, entitled "Articulated Walking Toy Device", and is a continuation of International Application No. PCT/US07/10991 filed May 4, 2007 with the same title, the disclosures of which are incorporated by reference herein in their entireties.

BACKGROUND OF THE INVENTION

This invention generally relates to powered, motive toys and, in particular, to articulated walking toys.

While articulated walking toys are generally known, it is believed that an articulated toy with an alternate motive mechanism for providing a more anatomic-like walking movement would be desirable.

BRIEF SUMMARY OF THE INVENTION

Briefly stated, the present invention is an articulated walking toy device configured for movement across a surface. The toy device comprises a frame and a plurality of leg assemblies movably coupled with the frame so as to at least partially support the frame for movement across the surface. Each leg assembly includes a leg member configured to rotate with respect to the frame about a joint. The joint is formed by a pin passed through an at least generally hour glass shaped aperture to provide rotational movement of the leg member with respect to the frame about at least first and second axes of rotation intersecting in the joint. A drive mechanism is operatively engaged with the plurality of leg assemblies so as to actuate each of the leg members to rotate about the first and second axes in a like, predetermined, repeatable cycle of movement. At least some of the leg members are out of phase with other leg members to produce an anatomic-like gait of the toy device upon actuation of the drive mechanism.

In another aspect, the present invention is an articulated device configured for walking movement across a surface. The device comprises a frame and a plurality of leg assemblies movably coupled with the frame so as to at least partially support the frame for movement across the surface. Each leg assembly includes a leg member configured to rotate with respect to the frame about a joint. A tab extends from the joint generally away from the leg member and includes a curved surface with a slot therealong. A crank is operably connected with the tab to slide along the slot such that rotation of the crank causes the leg member to pivot about a first axis of rotation of the joint. The crank has a cam surface operably connected with the curved surface such that rotation of the crank causes the cam surface of the crank to slide along the curved surface of the tab and pivot the leg member about a second axis of rotation of the joint. A drive mechanism is drivingly engaged with each of the plurality of leg assemblies through the tab of each leg assembly so as to cause each of the leg members of the leg assemblies to move in the at least two different directions in a like, predetermined, repeatable cycle of movement of each leg member. Movement of at least some of the plurality of the leg members is unsynchronized with movement of others of the plurality of the leg members, such that the plurality of leg members produce an anatomic-like gait of the device across the surface.

BRIEF DESCRIPTION OF THE SEVERAL VIEWS OF THE DRAWINGS

The foregoing summary, as well as the following detailed description of a preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown.

In the drawings.

DETAILED DESCRIPTION OF THE INVENTION

Figure 1:
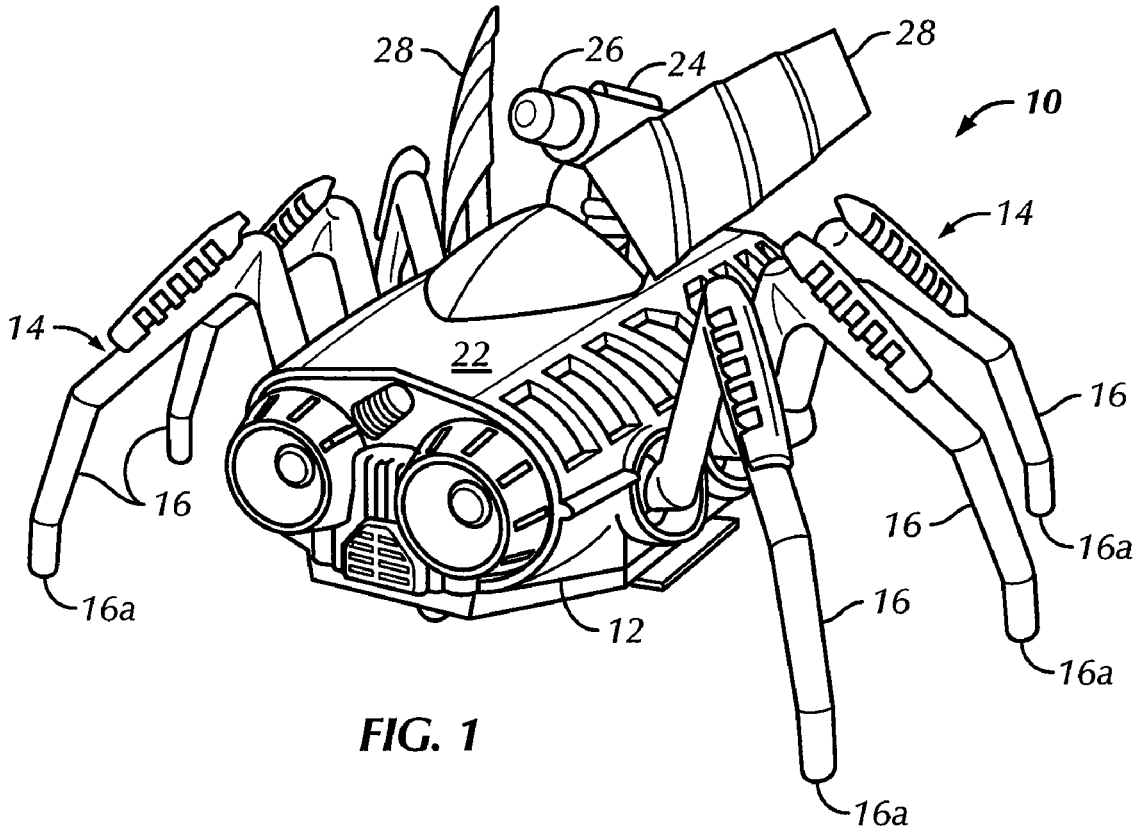
FIG. 1 is a top right front perspective view of an articulated toy device in accordance with a preferred embodiment of the present invention.

Certain terminology is used in the following description for convenience only and is not limiting. The words "right," "left," "upper," and "lower" designate directions in the drawings to which reference is made. The words "inwardly" and "outwardly" refer to directions toward and away from, respectively, the geometric center of an articulated walking toy device in accordance with the present invention, and designated parts thereof. The terminology includes the words noted above, derivatives thereof and words of similar import.

Unless specifically set forth herein, the terms "a", "an" and "the" are not limited to one element but instead should be read as meaning "at least one".

Referring to the drawings in detail, wherein like numerals indicate like elements throughout, there is shown in FIGS. 1-6 preferred embodiments of an articulated walking toy device, indicated generally at 10, configured for movement across a surface (not shown) in accordance with the present invention. The toy device 10 includes a frame 12 and a plurality of leg assemblies 14 movably coupled with the frame 12 so as to at least partially support the frame 12 for movement across the surface, as will be described in more detail below. Each leg assembly 14 includes a leg member 16. Preferably, the toy device 10 includes six leg members 16, three leg members 16 on each opposing lateral side of a body or frame 12, to mimic an insect-like creature. The leg members 16 are preferably curved in order for a distal end of the leg members 16*a* to support the frame 12 above the surface and to give the device 10 an animal-like appearance. The leg members 16, toward the front and rear of the device 10, are preferably curved or angled toward the front or rear of the device 10 respectively, but it is within the spirit and scope of the present invention that the leg members 16 are identically shaped or have any shape capable of performing the desired movement. It is also within the scope of the present invention that there be more or less than six leg members 16, provided the toy device 10 can still function to propel or support and propel the toy device 10, as described herein.

The toy device 10 is intended to have a power source, such as one or more batteries 18 (see FIGS. 4 and 5) disposed within a battery case 20, for instance, to power movement of the toy device 10. Furthermore, it is preferred that the toy device 10 have control electronics (not shown) within a control electronics housing (not shown) and be remotely controlled by a user using a generally conventional remote control device (not shown) spaced from the toy device 10. Additionally, it is intended that the toy device 10 includes a decorative outer housing 22, which is decorated in a manner that is visually pleasing to the user, for instance, giving the toy device 10 a robotic, bug-like, and/or monster-like appearance.

Figure 2:
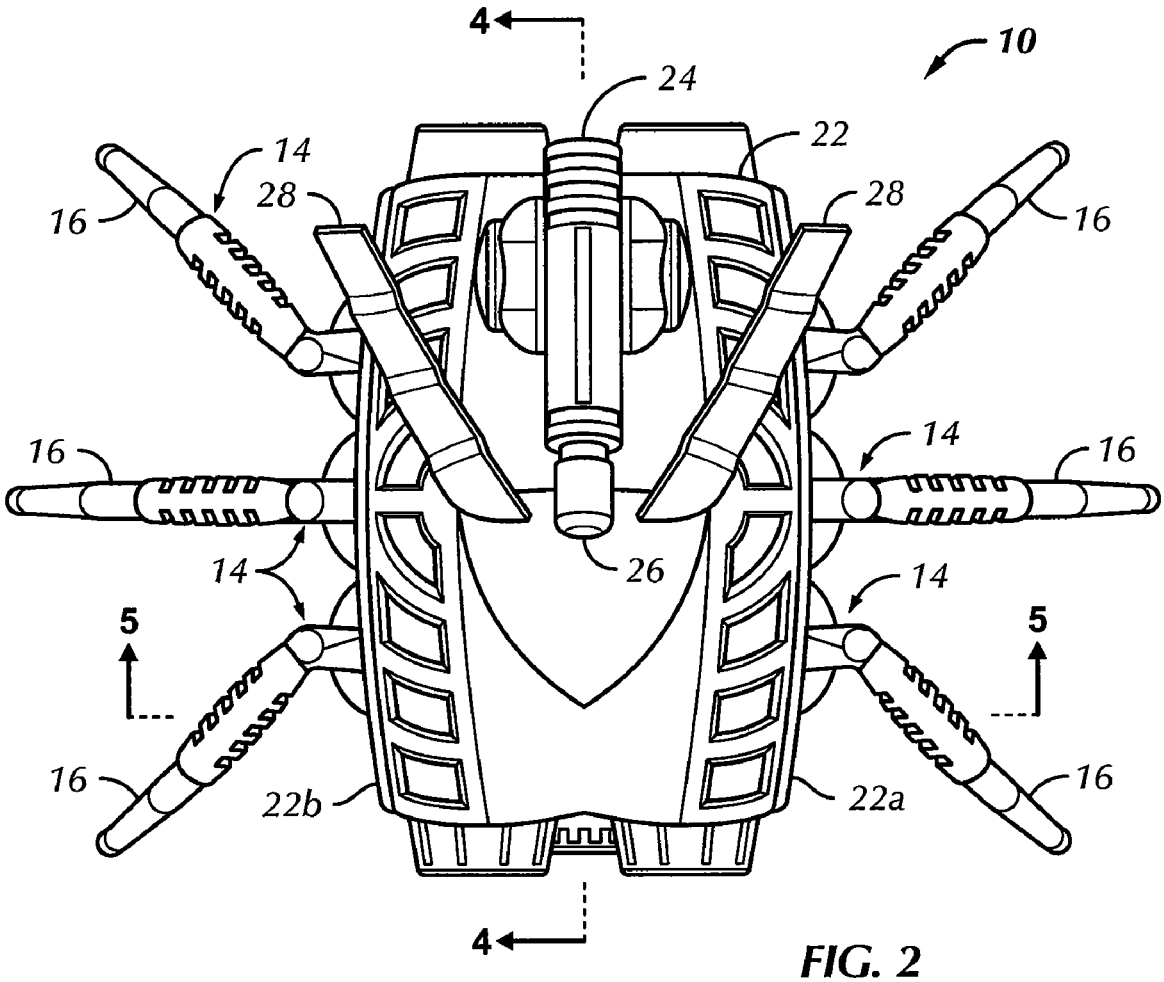
FIG. 2 is a top plan view of the toy device of FIG. 1.

Referring to FIGS. 1-2, the toy device 10 preferably includes a generally conventional, spring actuated projectile launcher 24 engaged to a top surface of the outer housing 22. The projectile launcher 24 preferably uses conventional means to allow a single dart 26 to be selectively fired by a user. The toy device 10 further includes wing-like, preferably stationary, structures 28 positioned on either side of the projectile launcher 24 to mimic wings or wing covers of an insect. While this is preferred, it is within the spirit and scope of the present invention that the projectile launcher 24 be configured differently so as to operate in a different, generally conventional manner and/or to fire more than one dart 26. It is also contemplated that the wing-like structures 28 of the toy device 10 be eliminated or differently configured. Furthermore, the projectile launcher 24 could be eliminated or replaced with a different device to perform a different function, such as a flashlight to illuminate an area around the toy device, a crane-like member to allow the user to pick up and move objects during play, or a canister for expelling a web-like substance, for instance.

Figure 3:
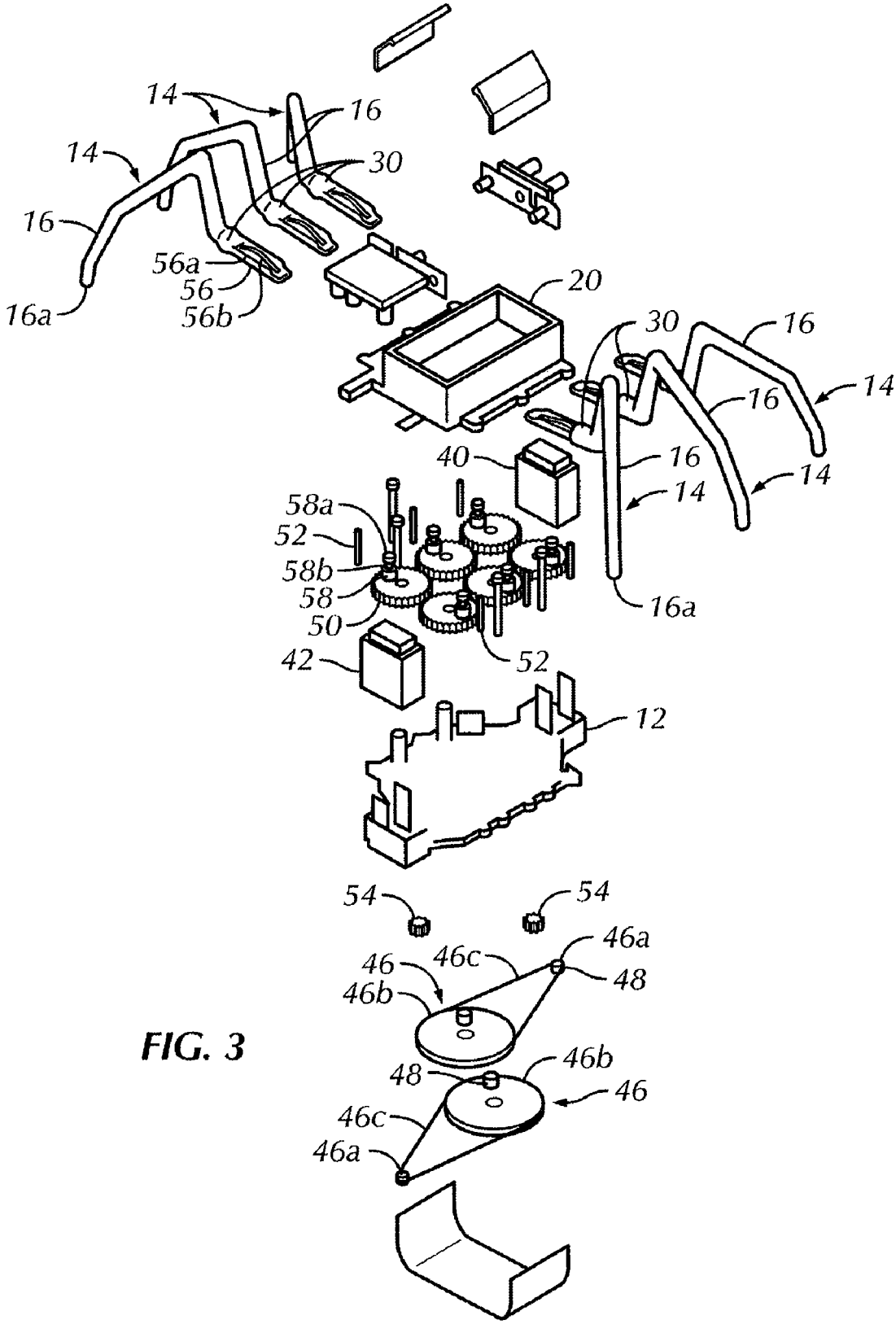
FIG. 3 is an exploded perspective view the toy device of FIG. 1 having an outer housing and a projectile launcher removed.
Figure 4:
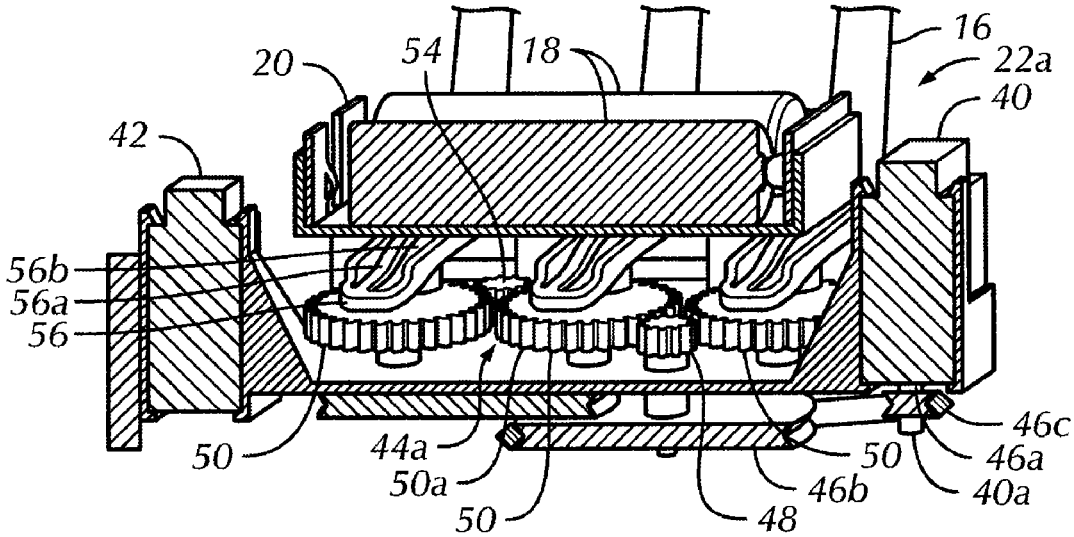
FIG. 4 is an enlarged cross-sectional view of the toy device of FIG. 1 taken generally along line 4-4 of FIG. 2, the toy device having the outer housing and the projectile launcher removed.
Figure 5:
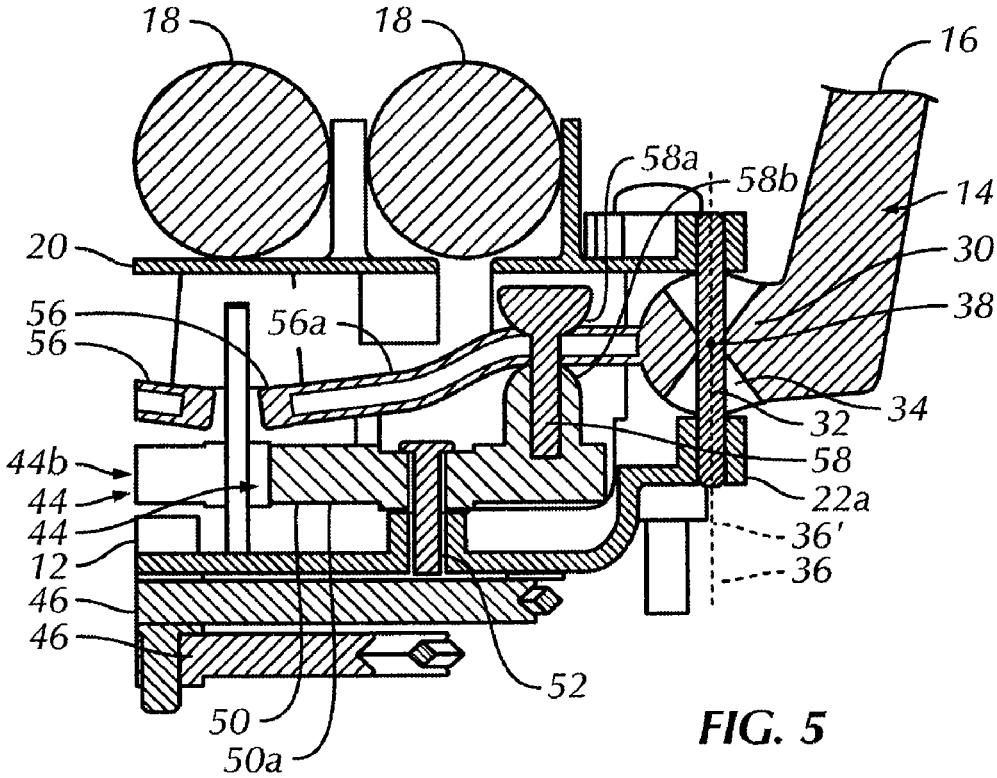
FIG. 5 is an enlarged cross-sectional view of the toy device of FIG. 1 taken generally along line 5-5 of FIG. 2, the toy device having the outer housing and the projectile launcher removed.

Referring to FIGS. 3-5, the plurality of leg members 16 are preferably attached to the frame 12 in a manner to allow the leg members 16 to move generally in at least two rotational directions, and, specifically, to pivot back and forth with respect to the frame 12 and to allow distal ends 16*a* of the leg members 30 to be raised and lowered with respect to the surface on which the toy device 10 is supported. The leg members 16 are arranged on first and second sides 22*a*, 22*b* of the device 10. Preferably, the leg members 16 are configured to rotate with respect to the frame 12 about a joint 30 having at least two degrees of freedom. The joint 30 is preferably formed by a pin 32 passed through an hour glass shaped aperture 34 to provide rotational movement of the leg member 16 with respect to the frame 12 about at least first and second axes of rotation 36, 38 intersecting in the joint 30. The pin 32 is preferably fixed to or stationary with respect to the frame 12 however it is within the spirit and scope of the present invention that the pin 32 be attached to the joint 30 and rotatably retained within the frame 12 or between the frame 12 and the battery case 20. The shape of the aperture 34 allows rotation of the leg members 16 back and forth through interaction of the pin 32 with a narrow portion of the aperture 34 and pivoting of the leg members 16 upward and downward through interaction of the pin 32 with angled-out portions of the aperture 34. The aperture 34 has a central aperture axis 36' coaxial with the axis of rotation 36 of or about the pin 32. The aperture 34 is preferably disposed in a plane parallel with the central aperture axis 36' but the aperture 34 may also have an hour glass shape such that the aperture is formed about an axis of symmetry about the central aperture axis 36'. The joint 30 provides rotational movement of the leg members 16 with respect to the frame 12 about at least first and second axes of rotation 36, 38 intersecting in the joint 30. The first axis 36 is coaxial with the longitudinal axis of the pin 32 and the second axis of rotation extends generally perpendicular to the first axis 36 shown into the page in FIG. 4. Although the above-described joint is preferred, it is within the spirit and scope of the present invention that the leg members 16 be movably engaged with the frame 12 in a different manner, such as with a rotating hinge, a conventional universal joint or a ball-in-socket configuration (not shown), for instance, provided the leg members 16 are generally capable of moving in the at least two rotational directions, as described above.

Referring now to FIGS. 3 and 4, driving of the leg members 16 is preferably accomplished using first and second motors 40, 42, which each drive a separate drive trains or mechanism 44. The drive mechanisms 44 are essentially identical, with the first motor 40 driving a first drive mechanism 44*a* and the second motor 42 driving a second drive mechanism 44*b* on the first and second lateral sides 22*a*, 22*b* of the device 10 respectively. Because the drive mechanisms 44*a*, 44*b* are essentially identical, only the first drive mechanism 44*a* will be described in detail. The first motor 40 drives a pulley 46 including a first (smaller) pulley wheel 46*a* and a second (larger) pulley wheel 46*b*, which are rotatably engaged to one another with a belt 46*c*. An output shaft 40*a* of the first motor 40 is rotatably fixed with the first pulley wheel 46*a*, such that actuation of the first motor 40 drives the first pulley wheel 46*a* to rotation and, in turn, rotates the second pulley wheel 46*b*. A drive gear 48 is fixed to the second pulley wheel 46*b* so as to rotate therewith. Three cranks 50 are disposed in a line proximate first lateral side 22*a* of the frame 12. The cranks 50 are preferably comprised of leg gears 50*a*. The drive gear 48 is meshed with two adjacent leg gears 50*a* of the three leg gears 50*a* engaged with the frame 12 to rotate the two meshed leg gears 50*a* about respective pins 52. An idler gear 54 is disposed between the third leg gear 50*a* and the leg gear 50*a* adjacent thereto. In this way, each of the leg gears 50*a* is driven in the same rotational direction by the first motor 40. Rotation of the leg gears 50*a* causes movement of the leg members 16, as described below.

In this way, the first motor 40 controls operation of the leg members 16 on the first lateral side 22*a* of the toy device 10, and the second motor 42 similarly controls operation of the leg members 16 on the second lateral side 22*b* of the toy device 10, thereby allowing turning of the toy device 10 by actuating one of the first and second motors 40, 42 slower or in a direction opposite to the actuation of the other of the first and second motors 40, 42. While the above-described drive train configuration is preferred, it is within the spirit and scope of the present invention that other drive train configurations be used, provided the alternate drive train configuration functions to cause similar movement of the leg members 16 of the toy device 10. For instance, a single motor and a drive train having a generally convention throw-out gear could be used for the movement of all six leg members 16. In this way, when the motor is driven in a first direction, all leg members 16 move together in one direction (i.e., a forward walking motion of the toy device), and, when the motor is driven in a second direction, the leg members 16 on one lateral side of the toy device are caused to move in one direction (i.e., a rearward walking motion of the toy device), while the leg members on the other lateral side of the toy device, through operation of the throw-out gear, are caused to either move in an opposite direction (i.e., a forward walking motion of the toy device) or to stop motion, thereby allowing the toy device to be turned. Alternatively, each leg member 16 or smaller groups of leg members 16 could each have a separate motor and drive train.

Referring to FIGS. 3-5, each leg member 16 includes a tab 56 extending therefrom and disposed generally within the toy device 10 proximate the respective crank 50. The tab 56 includes a ramped, in particular, curved and preferably irregularly curved in a vertical plane as best seen in FIG. 5, surface 56*a* with a slot 56*b* therealong. The ramped surface 56*a* is preferably angled with respect to the frame 12 such that the proximal end of the tab 56 is closest to the frame 12 and becomes further spaced from the frame 12 moving toward the joint 30. The slot 56*b* accepts an eccentric post 58 extending from a top surface of the respective crank 50. Rotation of the crank 50 causes revolution of the post 58 and causes movement of the leg member 16 in a front and back motion, or a direction generally parallel to the frame 12, due to interaction of the slot 56*b* with the post 58. Because the post 58 is eccentric with respect to the crank 50, quick return back-and-forth motion of the leg member 16 is produced such that the leg member 16 moves slower in one rotational direction (i.e., rearward with respect to the toy device 10 when the toy device 10 moves in a forward direction) than the opposite rotational direction (i.e., forward with respect to the toy device 10 when the toy device 10 moves in a forward direction). The post 58 includes upper cam surface 58*a* and the crank 50 includes a cam surface 58*b*, which essentially sandwich and capture the tab 56 of the leg member 16 therebetween to constrain the leg member 16 and control up and down motion of the leg member 16 or otherwise pivot about the second axis of rotation 38 of the joint 30. In this way, up and down motion of the leg member 16, motion perpendicular to the frame 12, can be controlled by the profile of the tab 56, which in the depicted preferred embodiment parallels both the upper and lower ramped/curved surface 56*a* of the tab 56. That is, due to interaction of the ramped surface 56*a* of the tab 56 with the cam surfaces 58*a*, 58*b* of the post 58 and the crank 50 respectively, the leg member 16 is caused to pivot upwardly and downwardly during rotation of the crank 50. The shape of the ramped surface 56a is preferably tailored to cause the leg member 16 to be rotated in a first direction around the first axis of rotation 36 of the joint 30 during the cycle of movement then the leg member 16 is rotated in an opposing direction around the first axis of rotation 36 of the joint 30 during a remainder of the cycle of movement. In this way, the leg member 16 is moved in a cyclical walking motion during actuation of the first motor 40. Although not shown in FIG. 4, preferably, the cranks 50 are configured so that the eccentric posts 58 are offset from one another to cause an offset of the cyclical motion of each of the leg members 16 from one another so that when some of the leg members 16 are in the quick return phase of motion and is out of contact with the surface, others of the leg members 16 are in the slower phase of motion and in contact with the surface to ensure that the toy device 10 remains supported on the surface by at least some of the leg members 16 during motion of the toy device 10. This offset further causes the toy device 10 to mimic an anatomic gait in order to approximate ambulation of an actual six-legged creature, like an insect.

Figure 6:
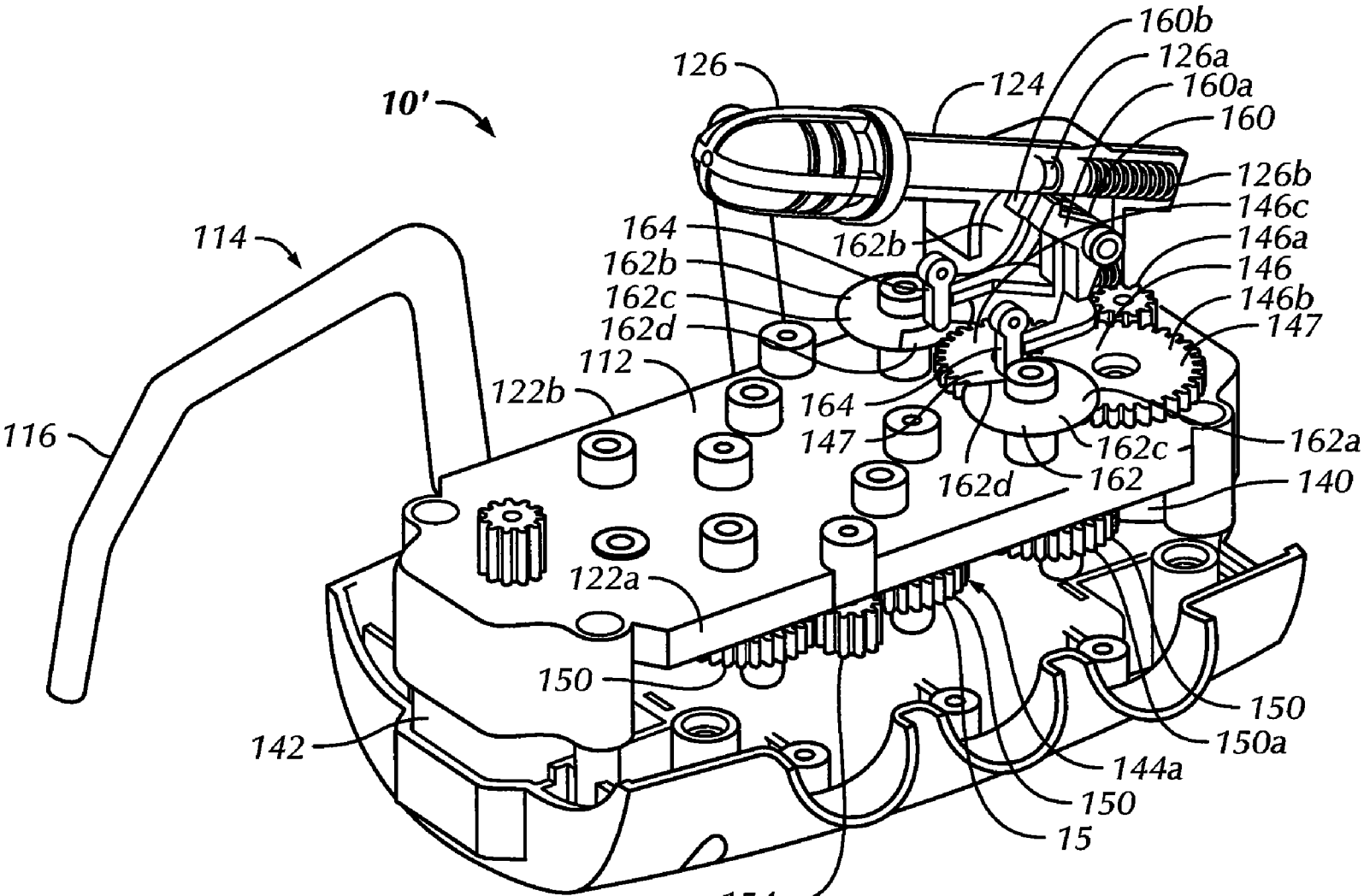
FIG. 6 is a partial view of the toy device of FIG. 1 having an alternative drive mechanism and projectile launcher control.
Figure 7:
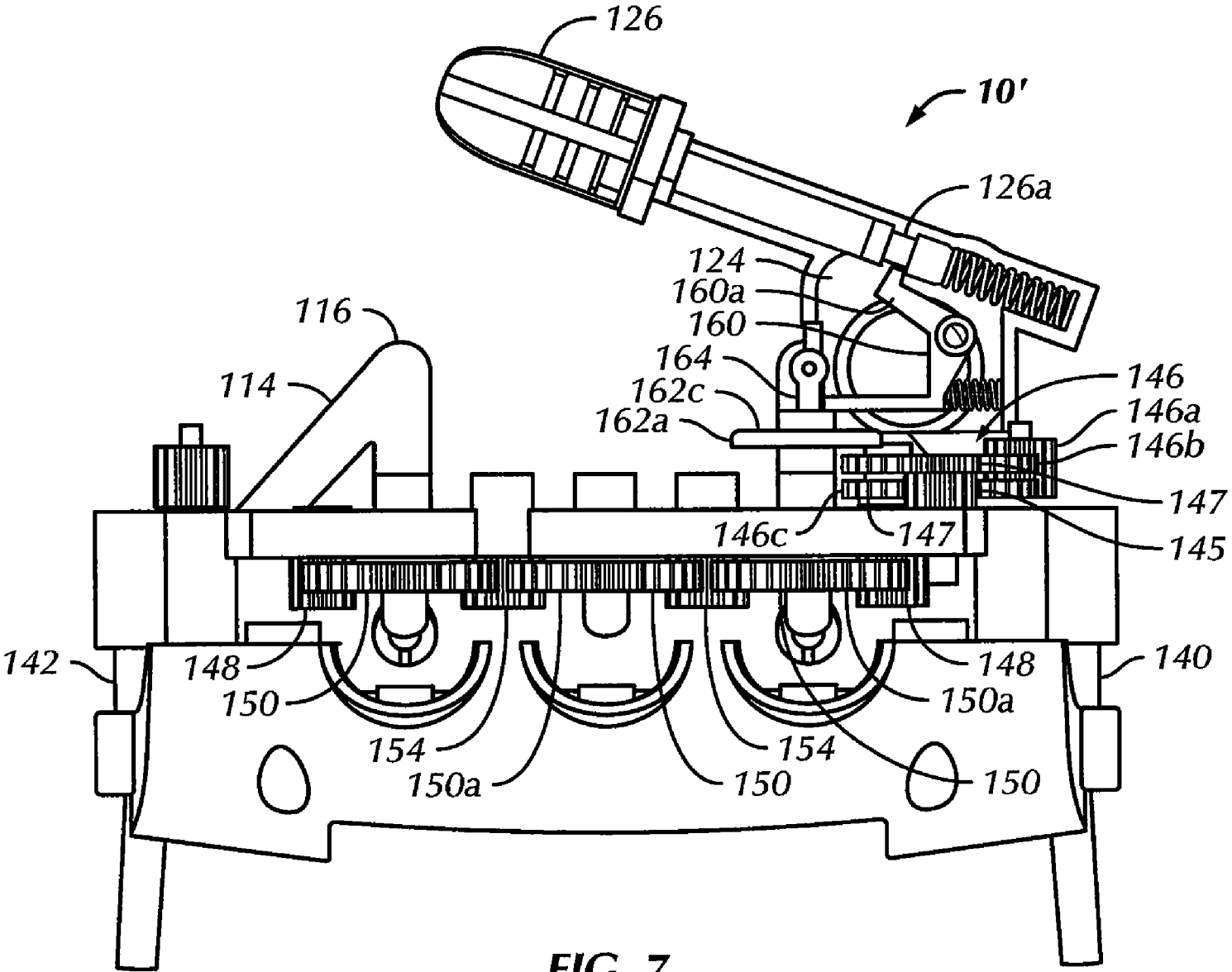
FIG. 7 is a side elevational view of the toy device of FIG. 6.

Referring to FIGS. 6 and 7, the toy device of FIGS. 1-5 may include an alternate driving mechanism 144. Numbers similar to those used in FIGS. 1-5 but incremented by one hundred indicate similar elements as discussed above but included in embodiment 10'. A discussion of the similar features has been eliminated for convenience only and is not limiting.

Driving of the leg members 116 is preferably accomplished using first and second motors 140, 142, which each drive a separate drive trains or mechanism 144. The drive mechanisms 144 are essentially identical, with the first motor 140 driving a first drive mechanism 144*a* and the second motor 142 driving a second drive mechanism (not shown) on the first and second lateral sides 122*a*, 122*b* of the device 10' respectively. Because the drive mechanisms 144*a* are essentially identical, only the first drive mechanism 144*a* will be described in detail. The first motor 140 drives a gear train 146 including a first gear 146*a*, a second gear 146*b* and a third gear 146*c*, which are rotatably attached to the frame 112. The first gear 146*a* is meshed with the second gear 146*b*. The second gear 146*b* and the third gear 146*c* are preferably identical combination spur gears, each having a smaller inner gear portion 145 and a larger outer gear portion 147 but mounted with an opposite orientation such that the smaller inner gear portion 145 meshes with the larger outer gear portion 147 on each second and third gear 146*b*, 146*c*, respectively. The third gear 146*c* is operably connected through the frame 112 to a drive gear 148. The third gear 146*c* and the drive gear 148 are preferably fixedly coupled together through a common axle (not shown). The drive gear 148 drives the cranks 150, leg gears 150*a* and the idler gears 154 to move the leg members 116 as was described above. The drive mechanisms 144 and the corresponding components may be oriented directly underneath the frame 112 such that the orientation of the drive mechanisms 144 and tabs (not shown) is inverse to the orientation of the drive mechanisms 44 described above.

The toy device 10 may include a latching mechanism 160 to releasably engage a dart 126 in a projectile launcher 124. The latching mechanism 160 is spring biased from the projectile launcher 124 and includes two separately pivotably latch legs 160*a* and 160*b*. The latch legs 160*a*, 160*b* retain the dart 126 by engaging with a ridge 126*a* in the dart 126. First and second sector wheels 162*a*, 162*b* are rotatatably mounted on the top of the frame 112 and driven with the leg gear 150*a* positioned on the opposing side of the frame 112 such that the sector wheels 162*a*, 162*b* are driven in the same direction as the corresponding leg gears 150*a*. The sector wheels 162*a*, 162*b* have a circular flange 162*c* with an outer periphery notch 162*d*. A pair of levers 164 are pivotably mounted above each sector wheel 162. The levers 164 are positioned such that the extend through the notches 162*d*. As the sector wheels 162*a*, 162*b* are rotated, the flanges 162*c* engage with the levers 164 to pivot the lever 164 in the direction of rotation. When the device moves in one of two longitudinal directions, preferably rearward toward the first motor 140, the sector wheels 162*a*, 162*b* rotate the corresponding levers 164 toward the latching mechanism 160 to pivot the latching mechanism 160 and releasing the latch legs 160*a*, 160*b* from the dart 126. Once the latch legs 160*a*, 160*b* are released, a spring 126*b* launches the dart 126 from the projectile launcher 124. Because the latch legs 160*a*, 160*b* are separately pivotable, both latch legs 160*a*, 160*b* must be released simultaneously in order to release the dart 126. To ensure that both latch legs 160*a*, 160*b* are released at the same time, the each drive mechanism 144 must be operated simultaneously in the same direction, again preferably corresponding to a reverse direction of the device 10'.

It will be appreciated by those skilled in the art that changes could be made to the embodiment described above without departing from the broad inventive concept thereof. In one important aspect of the invention, as few as a pair of the legs on opposite sides of the toy device could be used to propel the toy device. Two legs also could be used to both support and propel the toy device. For example, the distal, surface contacting end of each leg could be provided with a member or surface that resists rearward motion while permitting forward motion. This would permit each leg to be moved from a forward position to a rearward position as described above and brought back to a forward position without being raised from the support surface. Alternatively or in addition, each leg could be pivoted slightly downwardly at the end of its rearward movement to momentarily tilt the toy device away from that side before the leg is slightly raised from the surface and returned to a forward position. Also, a chassis with support wheels or equivalents could be provided and the leg assemblies used only for propulsion. Four leg assemblies could be used to mimic four-legged creatures (e.g., mammals, amphibians, and reptiles) while eight leg assemblies can be used to mimic arachnids.

While remote control of the toy device is preferred, it will be appreciated that the toy device can be factory preprogrammed to perform a predetermined movement or series of movements or configured to be selectively programmed by a user to create such predetermined movement(s). Alternatively or in addition, the toy device can be equipped with sensors, e.g., switches, proximity detectors, etc., that will control the toy device to turn away from or reverse itself automatically from whatever direction it was moving in if or when an obstacle is contacted or otherwise sensed.

It is understood, therefore, that this invention is not limited to the particular embodiment disclosed, but it is intended to cover modifications within the spirit and scope of the present invention.

We claim:

1. An articulated walking toy device configured for movement across a surface, the toy device comprising:

a frame;

a plurality of leg assemblies movably coupled with the frame so as to at least partially support the frame for movement across the surface, each leg assembly including a leg member configured to rotate with respect to the frame about a joint formed by a pin passed through an at least generally hour glass shaped aperture to provide rotational movement of the leg member with respect to the frame about at least first and second axes of rotation intersecting in the joint; and a drive mechanism operatively engaged with the plurality of leg assemblies so as to actuate each of the leg members of the plurality to rotate about the joint in a like, predetermined, repeatable cycle of movement, with at least some of the leg members of the plurality being out of phase with other leg members of the plurality to produce an anatomic-like gait of the toy device on the surface upon actuation of the drive mechanism.

2. The articulated walking toy device of claim 1, wherein the hour glass shaped aperture has a central aperture axis and the pin has a central longitudinal axis coaxial with the central aperture axis with the pin centered in the hour glass shaped aperture.

3. The articulated walking toy device of claim 1, wherein each leg assembly further comprises a crank and a tab operably connected with the crank and with the leg member, wherein the tab extends from the joint generally away from the leg member and includes a ramped surface with a slot therealong, wherein the crank is operably connected with the tab to slide along the slot such that rotation of the crank causes the leg member to pivot about the first axis of rotation of the joint.

4. The articulated walking toy device of claim 3, wherein the ramped surface is oriented transversely to a plane of rotation defined by the crank and wherein the crank has a cam surface operably connected with the ramped surface such that rotation of the crank causes the cam surface of the crank to slide along the ramped surface of the tab and pivot the leg member about the second axis of rotation of the joint.

5. The articulated walking toy device of claim 3, wherein interaction of the crank with the slot causes rotation of the leg member in a direction generally parallel to the surface supporting the plurality of leg members and interaction of the cam surface of the crank with the ramped surface causes rotation of the leg member in a direction generally perpendicular to the surface supporting the plurality of leg members.

6. The articulated walking toy device of claim 3, wherein the crank is located with respect to the tab and the joint such that, for each rotational cycle of the crank, the connected leg member is rotated faster in a first direction around the first axis of rotation of the joint during the cycle of movement than the leg member is rotated in an opposing direction around the first axis of rotation of the joint during a remainder of the cycle of movement.

7. The articulated walking toy device of claim 3, wherein the drive mechanism comprises:

at least a first motor supported from the frame; and a pulley wheel driven by the first motor and drivingly coupled to at least the leg assemblies disposed on a first lateral side of the device.

8. The articulated walking toy device of claim 7, wherein the drive mechanism further comprises:

a second motor supported from the frame and drivingly coupled to the leg assemblies disposed on a second lateral side of the device opposite the first lateral side for movement of the leg assemblies on the second lateral side independently of the movement of the leg assemblies on the first lateral side.

9. The articulated walking toy device of claim 7 wherein the crank of each leg assembly is provided by a leg wheel mounted for rotation on the frame and a post extending transversely to the wheel radially spaced from an axis of rotation of the leg wheel, the post including a cam surface operably connected with the tab on one side of the tab opposite the leg wheel, each leg wheel of at least the leg assemblies disposed on the first lateral side of the device being driven by the pulley wheel.

10. The articulated walking toy device of claim 9 further comprising a drive gear fixedly connected with the pulley wheel to rotate with the pulley wheel, the drive gear being drivingly engaged with the leg gear of a first leg assembly proximal the pulley.

11. The articulated walking toy device of claim 10 further comprising an idler gear between each pair of adjoining leg assemblies on at least the first lateral side of the frame operatively connecting the pair of adjoining leg assemblies for movement by simultaneous driving engagement with the leg gear of each of the pair of adjoining leg assemblies whereby operation the first motor causes rotation of each leg gear of each of the leg assemblies on at least the first lateral side of the frame in the same rotational direction to drive each of the leg assemblies on the first lateral side of the frame in the repeatable cycle of movement at the same time in same cyclical direction.

12. The articulated walking toy device of claim 3, wherein the drive mechanism comprises:

at least a first motor supported from the frame; and a gear train driven by the first motor and drivingly coupled to at least the leg assemblies disposed on a first lateral side of the device.

13. The articulated walking toy device of claim 1, wherein the drive mechanism comprises:

a first motor supported from the frame driving coupled to a first sector wheel and to at least one leg member on a first lateral side of the device;

a second motor supported from the frame driving coupled to a second sector wheel and to at least one leg member on a second lateral side of the device;

a spring biased projectile releasably coupled with the frame through a latch, the latch being driving coupled to the first and second sector wheels, the latch being moved and the projectile being released only when the device moves in one of two opposing longitudinal directions by simultaneous operation of the first and second motors.

14. The articulated walking toy device of claim 1, further comprising a spring actuated projectile launcher engaged to a top surface of an outer housing.

15. An articulated walking toy device configured for movement across a surface, the toy device comprising:

a frame;

a plurality of leg assemblies movably coupled with the frame so as to at least partially support the frame for movement across the surface, each leg assembly including a leg member configured to rotate with respect to the frame about a joint, a tab extending from the joint generally away from the leg member and including a curved surface with a slot therealong, a crank operably connected with the tab to slide along the slot such that rotation of the crank causes the leg member to pivot about a first axis of rotation of the joint, the crank having a cam surface operably connected with the curved surface such that rotation of the crank causes the cam surface of the crank to slide along the curved surface of the tab and pivot the leg member about a second axis of rotation of the joint; and a drive mechanism operatively engaged with the plurality of leg assemblies so as to actuate each of the leg members of the plurality to rotate about the joint in a like, predetermined, repeatable cycle of movement, with at least some of the leg members of the plurality being out of phase with other leg members of the plurality to produce an anatomic-like gait of the toy device on the surface upon actuation of the drive mechanism.

16. The articulated walking toy device of claim 15, wherein the joint is formed by a pin passed through an at least generally hour glass shaped aperture to provide rotational movement of the leg member with respect to the frame about the first and second axes of rotation intersecting in the joint.

17. The articulated walking toy device of claim 16, wherein the hour glass shaped aperture has a central aperture axis and the pin has a central longitudinal axis coaxial with the central aperture axis with the pin centered in the hour glass shaped aperture.

18. The articulated walking toy device of claim 15, wherein interaction of the crank with the slot causes rotation of the leg member in a direction generally parallel to the surface supporting the plurality of leg members and interaction of the cam surface of the crank with the curved surface causes rotation of the leg member in a direction generally perpendicular to the surface supporting the plurality of leg members.

19. The articulated walking toy device of claim 18, wherein the crank is located with respect to the tab and the joint such that, for each rotational cycle of the crank, the connected leg member is rotated faster in a first direction around the first axis of rotation of the joint during the cycle of movement than the leg member is rotated in an opposing direction around the first axis of rotation of the joint during a remainder of the cycle of movement.

20. The articulated walking toy device of claim 18 wherein the crank of each leg assembly is provided by a leg wheel mounted for rotation on the frame and a post extending transversely to the leg wheel radially spaced from an axis of rotation of the leg wheel, the post passing though the slot and including a cam surface facing the tab on a side of the tab opposite the leg wheel such that the tab is captured by the post between the cam surfaces of the leg wheel and the post.

21. The articulated walking toy device of claim 15, wherein the drive mechanism comprises:

at least a first motor supported from the frame; and a pulley wheel driven by the first motor and drivingly coupled to at least the leg assemblies disposed on a first lateral side of the device.

22. The articulated walking toy device of claim 21, wherein the drive mechanism further comprises:

a second motor supported from the frame and drivingly coupled to the leg assemblies disposed on a second lateral side of the device opposite the first lateral side for movement of the leg assemblies on the second lateral side independently of the movement of the leg assemblies on the first lateral side.

23. The articulated walking toy device of claim 22 wherein the crank of each leg assembly is provided by a leg wheel mounted for rotation on the frame and a post extending transversely to the leg wheel radially spaced from an axis of rotation of the leg wheel, the post including a cam surface operably connected with the tab, each leg wheel of at least the leg assemblies disposed on the first lateral side of the device being driven by the pulley wheel.

24. The articulated walking toy device of claim 23 wherein the leg wheel of each leg assembly is a leg gear and further comprising a drive gear fixedly connected with the pulley wheel to rotate with the pulley wheel, the drive gear being drivingly engaged with the leg gear of a first leg assembly proximal the pulley.

25. The articulated walking toy device of claim 22 further comprising an idler gear between each pair of adjoining leg assemblies on at least the first lateral side of the frame operatively connecting the pair of adjoining leg assemblies for movement by simultaneous driving engagement with the leg gear of each of the pair of adjoining leg assemblies whereby operation the first motor causes rotation of each leg gear of each of the leg assemblies on at least the first lateral side of the frame in the same rotational direction to drive each of the leg assemblies on the first lateral side of the frame in the repeatable cycle of movement at the same time in same cyclical direction.

* * * * *